US011859466B2

(12) United States Patent
Boyle

(10) Patent No.: US 11,859,466 B2
(45) Date of Patent: Jan. 2, 2024

(54) EXERCISE TOOL

(71) Applicant: Viking Completion Technology FZCo, Dubai (AE)

(72) Inventor: Colin Scott Boyle, Dubai (AE)

(73) Assignee: VIKING COMPLETION TECHNOLOGY FZCo, Dubai (AE)

( * ) Notice: Subject to any disclaimer, the term of this patent is extended or adjusted under 35 U.S.C. 154(b) by 0 days.

(21) Appl. No.: 17/587,288

(22) Filed: Jan. 28, 2022

(65) Prior Publication Data

US 2022/0243556 A1 Aug. 4, 2022

(30) Foreign Application Priority Data

Feb. 1, 2021 (GB) ..... 2101383

(51) Int. Cl.
*E21B 34/14* (2006.01)

(52) U.S. Cl.
CPC ..... *E21B 34/14* (2013.01); *E21B 2200/06* (2020.05)

(58) Field of Classification Search
CPC ..... E21B 34/14; E21B 2200/06
See application file for complete search history.

(56) References Cited

U.S. PATENT DOCUMENTS 5,145,228 A * 9/1992 Boyle ..... E21B 31/20 294/86.18
6,273,187 B1 8/2001 Voisin et al.
7,347,268 B2 3/2008 Layton
7,347,269 B2 3/2008 Layton
8,893,806 B2 11/2014 Williamson et al.
9,845,661 B2 12/2017 Williamson et al.
2010/0270034 A1 10/2010 Clausen
2010/0282475 A1* 11/2010 Darnell ..... E21B 34/14 166/373
2013/0048271 A1 2/2013 VanLue
2013/0048273 A1 2/2013 Crow et al.
2014/0196912 A1 7/2014 Turley et al.
2016/0053562 A1* 2/2016 Frosell ..... E21B 23/04 166/381

FOREIGN PATENT DOCUMENTS

AU 2012201018 A1 3/2012

OTHER PUBLICATIONS

Intellectual Property Office of the UK Patent Office; Search Report for GB2101383.4; dated Apr. 15, 2021; one page; Intellectual Property Office of the UK, Newport, South Wales, United Kingdom.

* cited by examiner

*Primary Examiner* — Dany E Akakpo
(74) *Attorney, Agent, or Firm* — LAW OFFICE OF JESSE D. LAMBERT, LLC

(57) ABSTRACT

An apparatus and method for creating axial movement of an inner sliding sleeve member on a tool in a downhole environment. The apparatus has keys which mate in a profile on the inner sliding sleeve member, the keys being held in a carrier on a sleeve around an inner mandrel. The inner mandrel includes stops and a lip which can be slid over the keys to retract them for release from the inner sliding sleeve member. By picking up and shifting down the mandrel relative to the sleeve, the apparatus is cycled to jar up, jar down and release. An exercise tool to release a stuck flow tube of a subsurface safety valve is described.

20 Claims, 4 Drawing Sheets

EXERCISE TOOL

Figure 1:
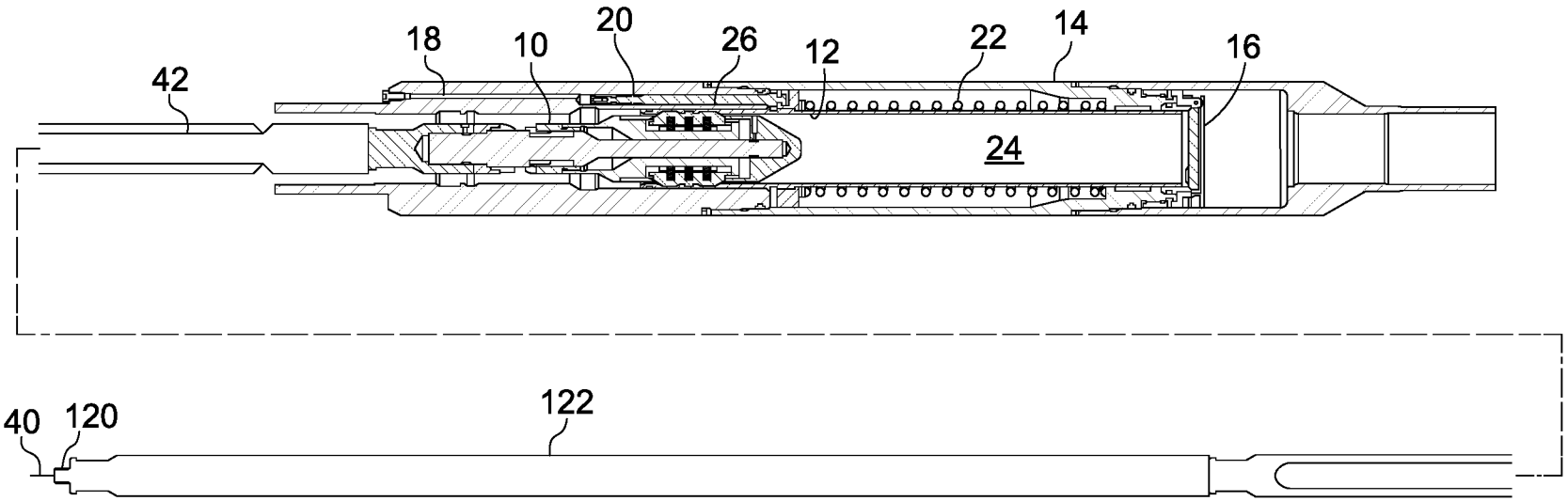
Figure 2A:
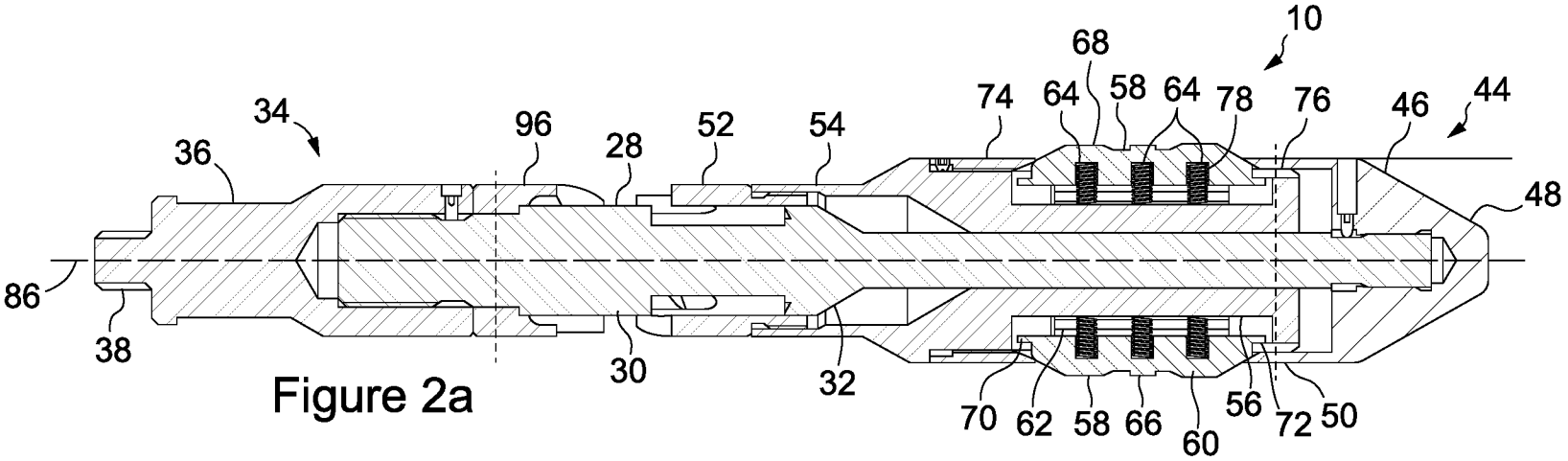
Figure 2D:
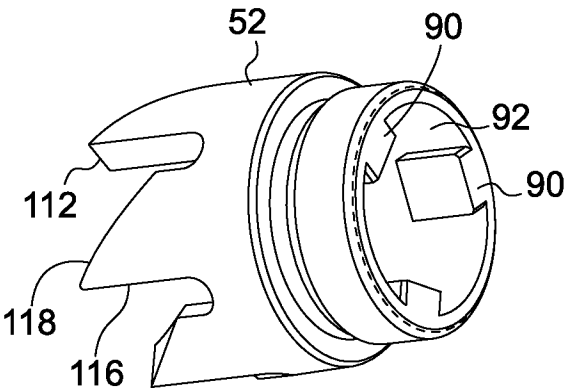
Figure 2C:
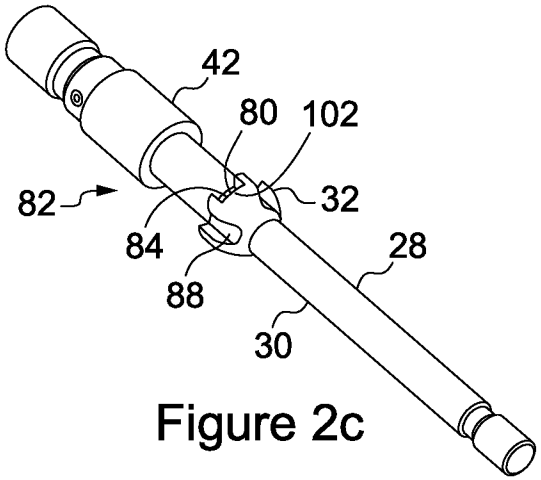
Figure 2B:
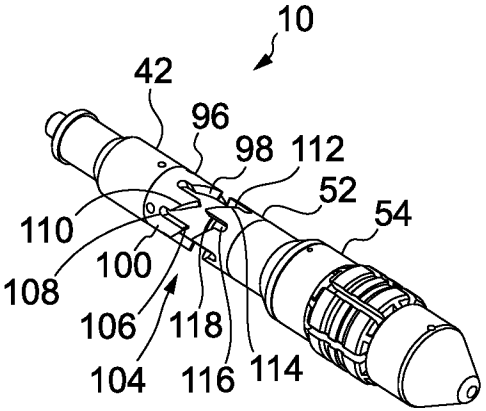

The present invention relates to an apparatus and method for creating axial movement of a sliding sleeve member on a tool in a downhole environment and in particular, though not exclusively, to exercising a flow tube of a subsurface safety valve located in a well.

Many downhole tools are mechanically operated by movement of a sliding sleeve member when in the well. One such tool is a subsurface safety valve (SSSV) which is incorporated within the well structure to protect against high pressure and high temperature formation fluids from travelling unimpeded to the surface during operations. A typical SSSV has a flapper valve held open by the action of a piston against a flow tube, which is maintained in position by hydraulic fluid pressure from a control line. If hydraulic fluid pressure is lost, the SSSV will immediately close, by axial movement of the flow tube to release the spring-biased flapper valve, preventing passage of the production fluids through the tubing to the surface, in response to the identification of abnormal or potentially dangerous conditions.

It is common for the SSSV to be subjected to many years of operation being exposed to severe conditions. Precipitates can fall out of solution in the well during production and can solidify around the flow tube of the SSSV. Over time this scale and solids accumulation can increase the friction of the SSSV flow tube reaching a point where the power spring cannot close the flapper valve and the piston cannot open the flapper valve.

As a means of remediating and cleaning of the SSSV to reduce the risk of malfunctioning, an exercise tool is used. Such mechanical exercise tools are run into the valve, connect to the flow tube and are moved axially up and/or down so as to move the flow tube up and/or down and thereby perform flow tube exercising.

U.S. Pat. No. 7,347,268 describes a flow tube exercising tool and method for actuating the flow tube of a downhole safety valve in order to remove build ups of scale and debris from the safety valve and ensure proper operation. The exercising tool provides an engagement portion that underlies the lower end of the safety valve flow tube so that upward movement of the exercising tool will move the flow tube upwardly. Hydraulic fluid is then provided to the safety valve hydraulic controller to move the flow tube downwardly. Only a single trip of the flow tube exercising tool is necessary to accomplish multiple upward and downward movements of the flow tube.

This exercising tool is limited to only being able to operate in a SSSV which is open, as the tool provides an upward movement to the flow tube. Thus it cannot be used in a SSSV in which the flow tube is stuck in a closed position since only hydraulic fluid pressure can be used to move the flow tube downwards.

A further disadvantage of this exercising tool and other current mechanical exercise tools is that once detached from the flow tube, they must be pulled out of hole (pooh) and redressed before re-entering and exercising the flow tube again. However, in order to confirm safety valve operation after exercising, the exercise tool should be disconnected from the flow tube. If after disconnection the flow tube remains stuck, the current exercise tools can't be reattached to exercise the flow tube again.

It is therefore an object of the present invention to provide an apparatus for creating axial movement of a sliding sleeve member on a tool in a downhole environment which obviates or mitigates at least one disadvantage of the prior art.

It is therefore an object of the present invention to provide a method for creating axial movement of a sliding sleeve member on a tool in a downhole environment which obviates or mitigates at least one disadvantage of the prior art.

According to a first aspect of the present invention there is provided apparatus to be run in a well, for creating axial movement of an inner sliding sleeve member on a tool previously located in the well, the inner sliding sleeve member of the tool including a first profile on an inner surface, the apparatus comprising:

- an inner mandrel having a coupling at a first end to connect to a work string and an end cap with an upper facing lip at an opposing end, the inner mandrel including first and second spaced apart stops located there upon;
- a first sleeve located around the inner mandrel and moveable relative thereto, the first sleeve comprising a key carrier in which is located a plurality of keys biased radially outwards from the inner mandrel, each key having a second profile on an outer surface;
- wherein the apparatus engages the inner sliding sleeve member via mating of the first and second profiles and a force on the upper end of the inner mandrel is transmitted to the inner sliding sleeve member; and
- the apparatus disengages from the inner sliding sleeve member by moving the upper facing lip over the plurality of keys to retract the keys to release the apparatus from the inner sliding sleeve member.

In this way, the keys engage with the inner sliding sleeve member and movement up or down by jarring can be applied through the apparatus to the inner sliding sleeve member. The apparatus can also be re-used downhole by moving the upper facing lip off the plurality of keys and they will radially extend to mate the first and second profiles again. Additionally, no separate lock is required before the keys locate into the inner sliding sleeve member, the first and second profiles can be selected to ensure the keys do not engage with any other profiles in the well and the tool does not require any seals or hydraulic lines to operate, being a simple mechanical construction.

Preferably, the first sleeve includes at least one raised portion on an inner surface, the at least one raised portion providing an abutment surface to contact the second stop. The at least one raised portion may be considered as a lug. A plurality of raised portions may be arranged equidistantly around the circumference of the inner surface of the first sleeve.

Preferably, the second stop does not extend entirely circumferentially around the inner mandrel. It may describe a portion of an arc around the circumference of the inner mandrel or a plurality of portions of arcs around the circumference of the inner mandrel which are spaced apart. In this way, by radial alignment of the inner mandrel and the first sleeve, the abutment surface of the at least one raised portion can be aligned to contact the second stop and thereby limit relative travel between the first sleeve and the inner mandrel or if misaligned, the first sleeve can bypass the second stop and travel further relative to the inner mandrel.

Preferably the inner mandrel includes at least one pocket arranged on an outer surface of the inner mandrel, a base of the at least one pocket being the second stop. More preferably the at least one pocket is dimensioned to accept the at least one raised portion. In this way a lug on the first sleeve locates in a pocket on the inner mandrel to limit travel of the first sleeve relative to the inner mandrel.

Preferably also, there are a plurality of pockets arranged equidistantly around the circumference of the outer surface of the inner mandrel. In an embodiment, there are an equal number of raised portions to pockets. Preferably, a slot is arranged between adjacent pockets. In this way, when a raised portion is aligned with a slot, the first sleeve bypasses the second stop allowing the first sleeve to travel relatively further along the inner mandrel.

Preferably the apparatus includes an indexing mechanism to provide radial alignment of the first sleeve and the inner mandrel, the indexing mechanism comprising: an upper orientation sleeve located around and attached to the inner mandrel, the upper orientation sleeve including a lower end with a first contour; a lower orientation sleeve, being the first sleeve, including an upper end with a second contour; the first and the second contours each comprising a longitudinal section and an angled section designed to mate when in contact, and wherein by picking up and shifting down of the work string rotational alignment of the inner mandrel and the first sleeve is controlled.

In this way, the at least one raised portions and the second stop can be aligned or misaligned. The lugs can therefore be selectively aligned with the pockets. The lugs can also be selectively aligned to bypass the pockets.

Preferably, the first contour is the first stop. In this way the upper orientation sleeve limits travel of the first sleeve in a first direction relative to the inner mandrel and the second stop limits travel of the first sleeve in a second direction relative to the inner mandrel.

Preferably the tool is a sub-surface safety valve and the inner sliding sleeve member is a flow tube of the sub-surface safety valve. The sub-surface safety valve may be a tubing retrievable flapper valve. Preferably the first profile is arranged at an upper end of the sub-surface safety valve and may be located on an adaptor attached to the sub-surface safety valve. Preferably the first profile extends entirely circumferentially around the inner surface of the tool. In this way, rotational alignment between the apparatus and the tool is not required in order to mate the first and second profiles.

The apparatus may further comprise one or more jars to apply the force on the upper end of the inner mandrel. The one or more jars may be mechanical jars.

According to a second aspect of the present invention there is provided a method of creating axial movement of an inner sliding sleeve member on a tool located in a well, the inner sliding sleeve member of the tool including a first profile on an inner surface, comprising the steps:

(a) running apparatus on a work string into the tool, the apparatus comprising:
  an inner mandrel having a coupling at a first end to connect to a work string and an end cap with an upper facing lip at an opposing end, the inner mandrel including first and second spaced apart stops located there upon;
  a first sleeve located around the inner mandrel and moveable relative thereto, the first sleeve comprising a key carrier in which is located a plurality of keys biased radially outwards from the inner mandrel, each key having a second profile on an outer surface;
(b) mating the first profile on the inner surface of the inner sliding sleeve member with the second profile of each key to engage the inner sliding sleeve member with the apparatus;
(c) applying a force on the upper end of the inner mandrel, the force being transmitted to and axially moving the inner sliding sleeve member; and
(d) moving the upper facing lip over the plurality of keys to retract the keys and release the inner sliding sleeve member from the apparatus.

In this way, the inner sliding sleeve member is moved by an applied force acting through the apparatus and the keys which engage the inner sliding sleeve member are retracted after use by using an upper facing lip to pass over them.

Preferably, the method includes the step of operating the apparatus in a first configuration with the first sleeve abutting the first stop and the force is applied in a second direction to jar down on the inner mandrel and the inner sliding sleeve member.

Preferably, the method includes operating the apparatus in a second configuration with the first sleeve abutting the second stop and the force is applied in a first direction to jar up on the inner mandrel and the inner sliding sleeve member.

In this way, an upward or downward jarring action can apply a force in either direction on the inner sliding sleeve member to move the inner sliding sleeve member in either axial direction.

Preferably, the method includes operating the apparatus in a third configuration with the first sleeve bypassing the second stop and the apparatus is picked-up for the upper lip to slide over the keys and release the apparatus from the inner sliding sleeve member.

Preferably, the method includes the further steps of locating the apparatus above the tool while remaining in a downhole environment; testing the inner sliding sleeve member from surface; and repeating steps (a) to (d). This allows the apparatus to be re-used in the event that the inner sliding sleeve member is not moving sufficiently when tested without having to pull the apparatus to surface and redress.

Preferably, the apparatus can be cycled between configurations when the first and second profiles are mated in the tool. In this way, the inner sliding sleeve member can be jarred up and down to assist in release or exercising as desired.

Preferably, the apparatus is moved between the configurations by rotational movement of the inner mandrel relative to the first sleeve via an indexing mechanism in the apparatus. More preferably, the work string is picked-up and shifted down to move between configurations. In an embodiment, the method includes performing a four-position cycle: shift down to jar down in the first configuration; pick-up to jar up in the second configuration; jar down and then pick-up to jar up and release in the third configuration. This may then include the further steps of running back in to mate the first and second profiles, and jarring down to repeat the cycle.

Preferably, the tool is a sub-surface safety valve, being a tubing retrievable flapper valve, and the inner sliding sleeve member is a flow tube of the sub-surface safety valve and the method includes the initial step of determining a position of the flapper valve. The flapper valve may be in the open or closed position and as such the flow tube may be stuck in either of these positions. When stuck in the open position, the flow tube will not move under the power spring force in the valve. When stuck in the closed position, the flow tube will not move under load from the hydraulic piston in the valve.

Preferably, with the flow tube stuck in the closed position, the method includes the steps of: applying an opening pressure to the valve control line at surface; at step (c) jarring down multiple times while monitoring the control line pressure; looking for a pressure drop to indicate that the flow tube and piston are stroking down; and then releasing the apparatus as in step (d); functioning the valve by applying and bleeding off control line pressure; and measuring a volume of hydraulic fluid pumped into the valve to determine that it is fully opening and closing.

These steps can be repeated as described above if the valve is not fully opening and closing.

Preferably, with the flow tube stuck in the open position, the method includes the steps of: venting the valve control line to atmosphere; at step (c) jarring up multiple times while measuring the control line returns; matching the returned fluid volume with an expected returned fluid volume for the valve to indicate that the flow tube and hydraulic piston of the valve are stroking up; and then releasing the apparatus as in step (d); functioning the valve by applying and bleeding off control line pressure; and measuring a volume of hydraulic fluid pumped into the valve to determine that it is fully opening and closing.

These steps can be repeated as described above if the valve is not fully opening and closing.

In the event that the valve is not able to fully open and close, the method may include the steps of: pulling the apparatus to surface; spot acid within a bore of the valve to remove scale or debris; and repeating the above described steps.

Ultimately, if the valve cannot be made to function correctly, the method may include the steps of running and installing an insert valve within the sub-surface safety valve. This will allow the well to be produced safely.

The apparatus of the present invention may be used to lock open the sub-surface safety valve prior to running and installing the insert valve. Preferably, the method includes the steps of: pressurizing the tubing string and recording the pumped volume to indicate when the pressure across the valve is equalized and fluid is being pumped through the flapper valve; run in the apparatus and engage the first and second profiles; jar up strongly to shear release screws of valve; jar down strongly to push flow tube through flapper and to lock flow tube in open position; pump down valve control line to verify that fluid is pumping into tubing string via the valve bore; pick up to disengage the apparatus and pull out of hole.

The apparatus may then be replaced with a wireline insert valve and running tool for the installation thereof as is known in the art.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different features and teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof. While the description refers to "upper" and "lower", "top" and "bottom", these terms are considered as relative, referring to "uphole" and "downhole" in a well, and thus equally apply to vertical, deviated and horizontal wells.

Figures 3A, 3B, 3C, 3D:
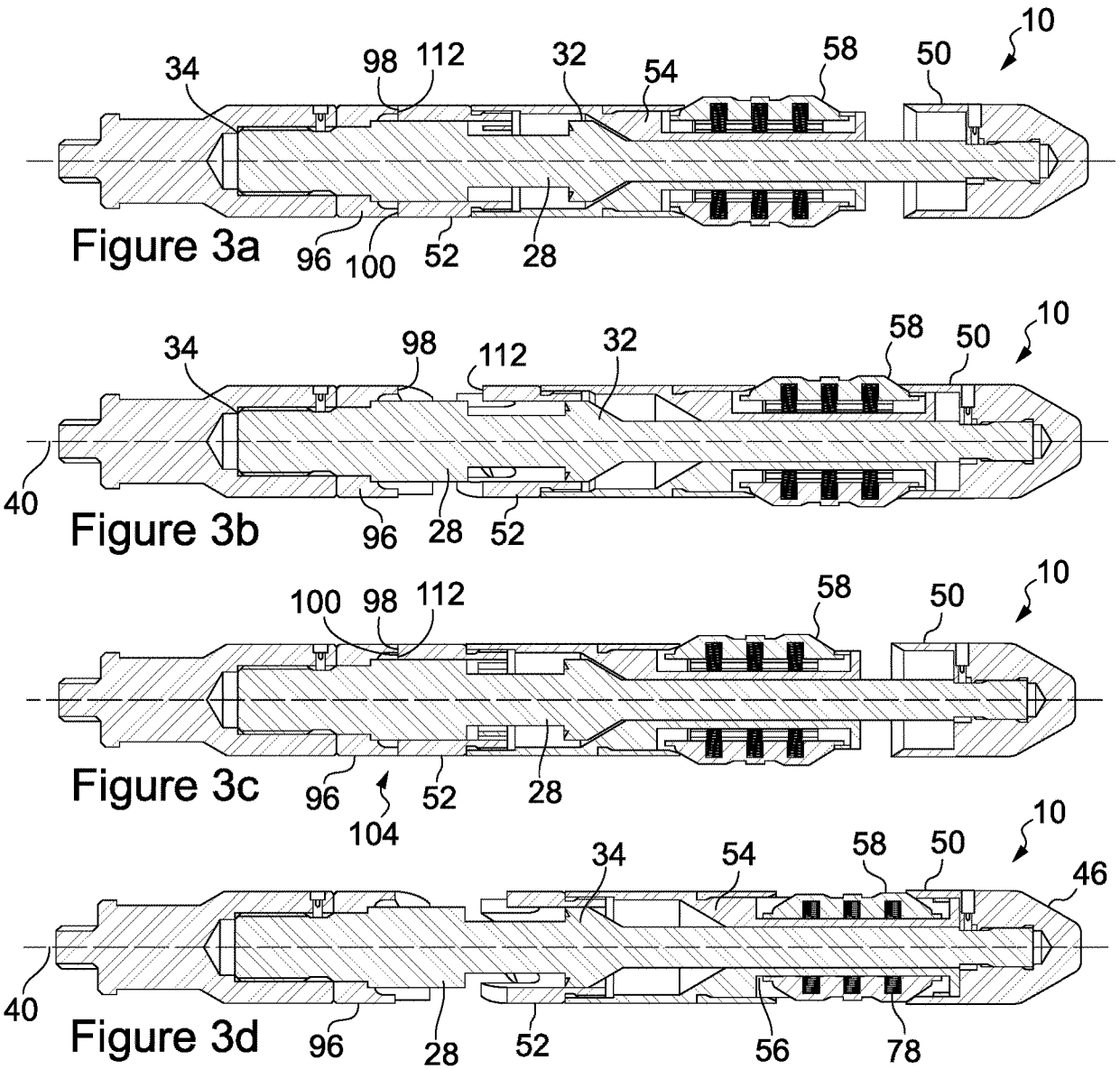
Figure 4A:
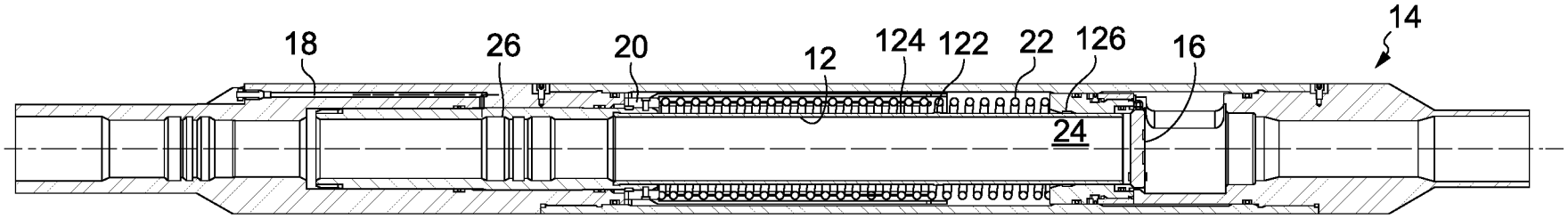
Figure 4B:
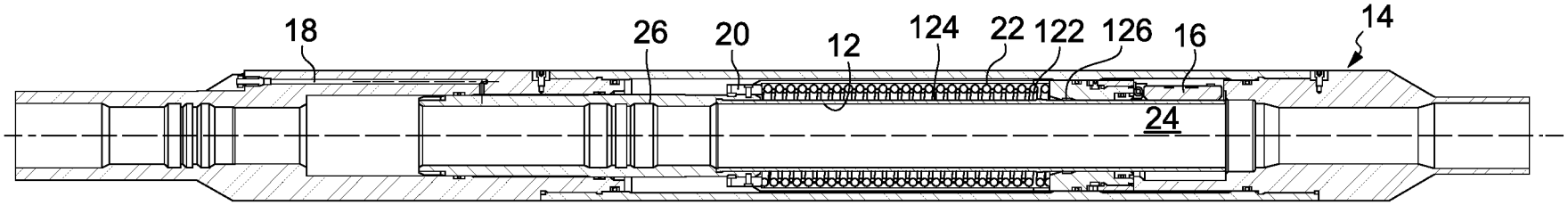
Figure 4C:
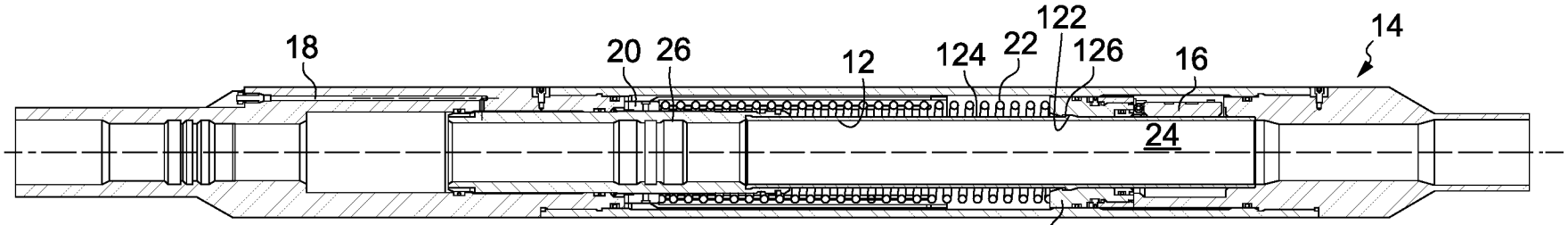

Embodiments of the present invention will now be described with reference to the following figures, by way of example only, in which:

FIG. 1 is a cross-sectional view of apparatus being run on a work string in a tool with an inner sliding sleeve member according to an embodiment of the present invention;

FIGS. 2(*a*)-(*d*) are of the apparatus of FIG. 1 as: (a) cross-sectional view through apparatus; (b) view of the apparatus; (c) view of the inner mandrel of the apparatus; and (d) view of the first sleeve of the apparatus;

FIGS. 3(*a*)-(*d*) are configurations which in order show the four-cycle operating sequence of the apparatus with (a) and (c) showing the first configuration, (b) showing the second configuration and (d) showing the third configuration according to embodiments of the present invention; and FIGS. 4(*a*)-(*c*) illustrate a tubing retrievable safety valve in (a) closed position, (b) open position and (c) locked open position to receive an insert valve.

Reference is initially made to FIG. 1 of the drawings which illustrates apparatus, generally indicated by reference numeral 10, for creating axial movement of an inner sliding sleeve member 12 on a tool 14 in a downhole environment, according to an embodiment of the present invention.

In this example, the tool 14 is a sub-surface safety valve which includes an inner sliding sleeve member 12 in the form of a flow tube whose axial movement opens and closes flapper 16 to operate the valve. In normal operation, hydraulic fluid is delivered from surface via a control line 18, to act upon a piston 20 which forces the flow tube 12 downwards against a spring 22, the flow tube 12 extending through the flapper 16 to hold it open. In this way, production fluids can pass up the bore 24 of the valve 14 to surface. If hydraulic fluid pressure is released on the control line 18, the spring 22 forces the flow tube 12 upwards to uncover the flapper 16, whereupon it will close the bore 24 and prevent the passage of fluids to surface. Re-applying pressure on the control line 18 will re-set the flapper 16 to the open position by moving the flow tube 12 back through the flapper 16. This acts as a safety feature and accordingly, it is imperative that the flow tube 12 can move easily and does not become stuck in the valve 14.

At the upper end of the flow tube 12 there is a cylindrical section, which may be formed as a separate adaptor attached to the flow tube 12. On this section there is provided a profile 26. Profile 26 provides a change in the diameter of the bore 24 over an axial length of the bore 24. The profile 26 typically is realised as a series of circumferential grooves.

Apparatus 10 is best described with reference to FIGS. 2(*a*)-(*d*). Centrally located through the apparatus 10 is an inner mandrel 28 being a substantially cylindrical body 30. At a first upper end 34 there is arranged a top sub 36 having a connector 38 to attach the apparatus to a work string 40 directly or via other tools such as a jar 42. At a lower second end 44 a bottom sub 46 is attached providing a bull nose 48 to direct the apparatus 10 through the bore 24. On the upper side of the bottom sub 46 is an upward facing lip 50 at an outer edge. The lip 50 provides a circumferential ring with a chamfered edge spaced apart from the body 30.

Located around the inner mandrel 28 is a sleeve 52. The sleeve 52 can rotate relatively around the inner mandrel 28 and travel axially along relatively to the inner mandrel 28. The sleeve 52 includes a key carrier 54. Key carrier 54 is an extension of the sleeve 52 and provides a recess 56 in which is located a number of keys 58. In the example embodiment, there are six keys 58 equidistantly spaced around the carrier 54 in the recess 56. Each key 58 has a part cylindrical body 60, an inner surface 62 within which are located three cavities 64, the outer surface 68 has a profile 66 machined therein, each profile 66 is identical being a series of grooves with straight and angled sides between upper and lower ends of the key 58, with the ends angled down to provide an upper ledge 70 and a lower ledge 72 at each end of the key 58. Upper and lower retaining rings 74,76 are located over the ledges 70,72 which may be keyed to prevent rotational movement of the keys 58. In each cavity 64 is located a compression spring 78, used to bias the key 58 away from a base of the recess 56. Thus the keys are forced radially outwards from the apparatus 10, with the radial travel restricted by the retainer rings 74, 76. However, the profile 66 on the outer surface 68 sits proud of the retainer rings 74,76 and the key carrier 54 when biased to their furthest position.

The lower retainer ring 76 has an outer diameter less than the inner diameter of the lip 50. In this way, the lip 50 can travel over the lower retainer ring 76, contact the angled outer surface of the key 58 and, via its chamfered edge, push the key 58 back into the recess 56 against the springs 78, to retract the outer surface 68 and the profile 66 into the key carrier 54 and apparatus 10.

The profile 66 is dimensioned to be the relief of the profile 26 on the tool 14. In this way, the apparatus 10 can locate into and grip the inner sliding sleeve member 12 of the tool 14, when run in the bore 24 and the profiles 66,26 are aligned to mate. The profiles 66,26 can be unique to ensure that the keys 58 of the apparatus 10 will not engage with any other profiles in the bore 24 when the apparatus 10 is run in.

A further feature is an enlarged portion 32 on the inner mandrel 28 providing a greater diameter to the body 30. This is best illustrated in FIG. 2(*c*) showing the inner mandrel 28 with the outer surface 42 of the top sub 36. The enlarged portion 32 includes a pocket 80 or recess at an upper end 82. One pocket 80 is illustrated, but there may be others arranged around the enlarged portion 32. The pocket 80 provides a base 84 being perpendicular to a central longitudinal axis 86 of the apparatus 10. The base 84 may be considered as a stop 102. Adjacent to the pocket 80 are slots 88 which are longitudinal grooves located entirely through the enlarged portion 32. There may be any number of slots 88 around the enlarged portion 32. A width of the pocket 80 is ideally equal to a width of the slot 88.

The sleeve 52, as shown in FIG. 2(*d*) has raised portions 90 upon its inner surface 92. Although three lugs 90 are shown, there may be any number to align with the pockets 32 and slots 88 of the enlarged portion 32 of the inner mandrel 28. The lugs 90 are located at a lower end 94 of the sleeve 52 and are dimensioned to fit with a pocket 80 and pass along a slot 88.

A further sleeve 96 is arranged and fastened to the inner mandrel 28, towards its upper end 34. This provides a first surface 98 facing the sleeve 52, and as it is fixed to the inner mandrel 28, provides a further stop 100 for relative longitudinal movement of the sleeve 52.

It is therefore apparent that the sleeve 52 including the key carrier 54 can move relative to the inner mandrel 28 between the stop 100 and the stop 102 when the lug 90 is aligned with the pocket 80. When the lug is aligned with the slot 88, sleeve 52 can bypass the enlarged portion 32, travelling further and resulting in the upper lip 50 contacting the keys 58. Further longitudinal movement will cause the keys 58 to retract into the recess 56. It is the rotational alignment of the inner mandrel 28 and the sleeve 52 which will determine the extent of longitudinal movement allowed by the sleeve 52 relative to the inner mandrel 28.

In the embodiment shown, the rotational alignment is controlled by an indexing mechanism 104. The first surface 98 of the further sleeve 96 is contoured 106 to describe a pathway with longitudinal sections 108 connected by angled sections 110. An upper surface 112 on the sleeve 52 facing the first surface 98 has a mating contour 114 of longitudinal sections 116 and angled sections 118. In this regard the sleeve 52 can be considered as a lower orientation sleeve 52 and the further sleeve is the upper orientation sleeve 96. With the lower orientation sleeve 52 held in position via the keys 58 being radially extended against the inner sliding sleeve member 12 of the tool 14, shifting the work string 40 will allow manipulation of the inner mandrel 28 so that it may be raised and shifted down to rotate the sleeves 52,96 relative to each other. This will align the lugs 90 with the pockets 80 or slots 88. The positions can be cycled to operate the apparatus 10.

In use, the apparatus 10 is arranged with the lower orientation sleeve 52 between the upper orientation sleeve 96 and the bottom sub 46. The apparatus 10 is mounted on a work string 40 and may include other tools, such as the jar 42, as shown in FIG. 1. The apparatus 10 is run-in the bore 24 of the tool 14 until the radially biased keys 58 engage in the profile 26 of the tool 14. On run-in the apparatus 10 will be in a first configuration as illustrated in FIG. 3(*a*). The upper and lower orientation sleeves 52,96 are adjacent with the contoured surfaces 98,112 mating and the surface 98 acting as a stop 100 preventing further movement of the lower orientation sleeve 52 upwards relative to the inner mandrel 28. The lower orientation sleeve 52 is spaced apart above the enlarged portion 32 of the inner mandrel 28. In this position, when the keys 58 engage and grip the inner sliding sleeve member 12 as the profiles 26,66 locate and mate, the apparatus 10 can be jarred downwards. A downward force is placed on the upper end 34 of the inner mandrel 28, it is transmitted through the upper orientation sleeve 96 and by the contact of the surfaces 98,112 to the lower orientation sleeve 52 and the key carrier 54. The downward force acts upon the keys 58 and consequently upon the inner sliding sleeve member 12 of the tool 14. Such a jarring force should move the inner sliding sleeve member 12 axially downwards to exercise it or to release it if it has become stuck. The jarring down action can be repeated if further movement is required.

Next the apparatus 10 is picked-up on the work string 40. The upper and lower orientation sleeves 96,52 separate, moving down the longitudinal sections 108,116 of the contours 106,114 on surfaces 98,112 and the lugs 90 locate in the pockets 80 of the enlarge portion 32. Travel of the sleeves 52,96 relative to each other is stopped as stop 102 is reached. The keys 58 remain engaged to the inner sliding sleeve member 12 and the apparatus 10 is then jarred upwards. The upward force placed on the upper end 34 of the inner mandrel 28 is transmitted to the lower orientation sleeve 52 through the pockets 80 of the enlarged portion 32. The upward force acts upon the keys 58 and consequently upon the inner sliding sleeve member 12 of the tool 14. Such a jarring force should move the inner sliding sleeve member 12 axially upwards to exercise it or to release it if it has become stuck. The jarring up action can be repeated if further movement is required. This second configuration of the apparatus is illustrated in FIG. 3(*b*).

The apparatus 10 is then shifted down with the upper orientation sleeve 96 meeting the lower orientation sleeve 52 and being directed along an angled section 118 of the surface 112 in the indexing mechanism 104 to rotationally align the lugs 90 with the slots 88. This is as illustrated in FIG. 3(*c*) with the upper and lower orientation sleeves 96,52 contacting each other again at the stop 100. The apparatus 10 is then pulled on the work string 40. When pulled, the keys 58 are initially retained in the profile 26 of the inner sliding sleeve member 12, with the result that the inner mandrel 28 moves upwards relative to the fixed lower orientation sleeve 52, and the slots 88 move over the lugs 90, allowing the lower orientation sleeve 52 to bypass the enlarged portion 32 of the inner mandrel 28. This upward movement of the inner mandrel 28 makes the upper lip 50 on the bottom sub 46 slide over the lower retaining ring 76 and contact the keys 58. The chamfered edge of the lip 50 mates with the angled profile 66 and forces it radially inwards against the springs 78 as the lip 50 travels upwards relative to the keys 58. The keys 58 are thus retracted into the recess 56 on the key carrier 54. As the keys 58 are retracted, they have released from the profile 26 of the inner sliding sleeve member 12 and the upward pulling force on the apparatus 10 will raise the apparatus 10 in the bore and out of the tool 14. This third configuration is shown in FIG. 3(*d*).

From the third configuration, the apparatus 10 can be run back into the profile 26 and by jarring down the index mechanism by be cycled to repeat the operation. This is useful if, once the apparatus 10 is outside the tool 14, the inner sliding sleeve member 12 is found to still be stuck or not functioning correctly and the apparatus 10 can be re-used without having to be pulled to surface and redressed.

As detailed above, with reference to FIG. 1, the apparatus 10 can be used in a subsurface safety valve such as a tubing retrievable flapper valve which would be the tool 14 with a flow tube as the inner sliding sleeve member 12. The apparatus 10 may therefore be considered as an exercise tool as is known in the art.

For use as an exercise tool 10 in a tubing retrievable safety valve (TRSV) 14, the exercise tool 10 is made up to a wireline tool string 40 comprising of a rope socket 120, a six-foot stem 122, mechanical jars 42 and the exercise tool 10, as shown in FIG. 1. The amount of stem 122 is used to adjust the tool string weight to ensure the wireline overcomes stuffing box friction to enter the well when the well is under pressure and determine the force applied in jarring down.

Prior to running the tool string 40, it should be determined if the flow tube 12 of the TRSV 14 is stuck in the open or closed position. This can be achieved by pressure determination in the well.

It is important that if the TRSV 14 is closed, pressure must be equalized across the flapper 16 before attempting to manipulate the flow tube 12 with the exercise tool 10. Severe damage to the flapper 16 or the hinge pin on which the flapper 16 pivots will occur if the jarring force of the exercise tool 10 on the flow tube 12 impacts the flapper 16.

The exercise tool 10 is run in hole until it reaches the TRSV 14. Run in slowly until the keys 58 on the exercise tool 10 engage the mating exercise profile 26 in the top of the flow tube 12. It will be necessary to jar up and down in order to determine the exercise tool position.

For the scenario in that the flow tube 12 is stuck in the closed position i.e. TRSV 14 will not open hydraulically and the flow tube 12 will not move down under load from the hydraulic piston 20. It is necessary to induce a downwards force from the exercise tool 10 to break the mechanical lock. Apply typical opening pressure to the TRSV control line 18 at surface and hold. Jar down lightly five times on the exercise tool 10. Monitor the control line 18 pressure while jarring. If the pressure drops this indicates that the flow tube 12 and piston 20 are stroking down. Release the exercise tool 10 as described hereinbefore with reference to FIGS. 3(*a*)-(*d*) and function the TRSV 14 by applying and bleeding off control line 18 pressure. Measure the volume of hydraulic fluid pumped into the valve 14 to determine if it is fully opening and closing.

If the pressure is stable the flow tube 12 has not moved. Maintain the control line 18 pressure and repeat jarring action but with more force. Monitor control line 18 pressure for indications that the flow tube 12 is moving. If the pressure drops this indicates that the flow tube 12 and piston 20 are stroking down. Release the exercise tool 10 as described hereinbefore with reference to FIGS. 3(*a*)-(*d*) and function the TRSV 14 by applying, and, bleeding off control line 18 pressure. Measure the volume of hydraulic fluid pumped into the valve 14 to determine if it is fully opening and closing.

If after heavier jarring the flow tube 12 has still not moved increase the control line 18 pressure to the maximum allowable and repeat the step above. If the flow tube 12 has still has not moved it may be possible to spot acid within the valve bore 24 to remove scale or debris. If the mechanical lock cannot be removed by any means it may be necessary to run and install an insert valve within the TRSV 14 to allow the well to be produced safely.

In the alternative where the flow tube 12 is stuck in the open position i.e. TRSV 14 will not close and the flow tube 12 will not move up under the power spring 22 force. It is necessary to induce an upwards force from the exercise tool 10 to break the mechanical lock. Ensure that no pressure is applied to the control line 18 and that it is vented to atmosphere. Jar up lightly five times on the exercise tool 10. Measure the control line 18 returns while jarring. If the returned fluid matches the volume shown on the data sheet for the valve 14 this indicates that the flow tube 12 and piston 20 are stroking up. Release the exercise tool 10 as described hereinbefore with reference to FIGS. 3(*a*)-(*d*) and function the TRSV 14 by applying and bleeding off control line 18 pressure. Measure the volume of hydraulic fluid pumped into the valve 14 to determine if it is fully opening and closing.

If no returns are observed the flow tube 12 has not moved. Repeat jarring action but with more force. Monitor control line 18 returns for an indication that the flow tube 12 is moving. If the returned fluid matches the volume shown on the data sheet for the valve 14 this indicates that the flow tube 12 and piston 20 are stroking up. Release the exercise tool 10 as described hereinbefore with reference to FIGS. 3(*a*)-(*d*) and function the TRSV 14 by applying, and, bleeding off control line 18 pressure. Measure the volume of hydraulic fluid pumped into the valve 14 to determine if it is fully opening and closing.

If the flow tube 12 still has not moved after a number of attempts it may be possible to spot acid within the valve bore 24 to remove scale or debris. If the mechanical lock cannot be removed by any means it may be necessary to run and install an insert valve within the TRSV 14 to allow the well to be produced safely.

The exercise tool 10 may also be used to lock the valve 14 open so that an insert valve can be installed. For this the exercise tool 10 is located on a wireline with mechanical jars 42 as described hereinbefore. Referring now to FIGS. 4(*a*) to (*c*) there is shown a tubing retrievable safety valve 14 with a flow tube 12. Like parts to the tool 14 of FIG. 1 have the same reference numerals to aid clarity. FIG. 4(*a*) illustrates the valve 14 in a closed configuration with the flapper 16 blocking the bore 24 while FIG. 4(*b*) illustrates the valve 14 in an open configuration with the flow tube 12 located through the flapper 16 to hold it open. The following method is used to decouple the flow tube 12 so that an insert valve can be installed. Pressurize up the tubing string 24 while recording the pumped volume to indicate when the pressure across the TRSV 14 is equalized and fluid is being pumped through the flapper valve 16. Run in with exercise tool 10 to engage profile 26 on valve 14 with keys 58 on tool 10 and slack off tool string weight. Then pick-up tool string weight plus, say, 500 lb (227 kg) to indicate correct engagement in the profile 26. Jar up strongly to shear release screws 120 in valve 14. Jar down strongly to push flow tube 12 through flapper 16 far enough to allow profiled lip 122 on the outer surface 124 of the flow tube 12 to engage in profiled recess 126 on valve housing 128 to lock flow tube 12 in open position. Pump down control line 18 to verify that fluid is pumping into tubing string via TRSV bore 24. Pick-up to disengage exercise tool 10 from profile 26 as described hereinbefore and POOH. The valve 14 is now as shown in FIG. 4(*c*) and by replacing the exercise tool 10 with a wireline insert valve and running tool, the insert valve can be located in the TRSV 14.

The principle advantage of the present invention is that it provides apparatus and method for creating axial movement of an inner sliding sleeve member on a tool in a downhole environment which can release from and re-engage the inner sliding sleeve member while downhole.

A further advantage of the present invention is that it provides an exercise tool for a sub-surface safety valve which is entirely mechanical with no seals or hydraulic control required, moves the safety valve flow tube up or down by jarring; releases from the safety valve as part of the jar up jar down operating sequence; doesn't require to be pooh and redressed if needed again once released and coupled with the relevant safety valve flow tube design the exercise tool can be used to lock open the safety valve so that an insert valve can be deployed.

We claim:

1. Apparatus to be run in a well, for creating axial movement of an inner sliding sleeve member on a tool previously located in the well, the inner sliding sleeve member of the tool including a first profile on an inner surface, the apparatus comprising:

an inner mandrel having a coupling at a first end to connect to a work string and an end cap with an upper facing lip at an opposing end, the inner mandrel including first and second spaced apart stops located there upon;

a first sleeve located around the inner mandrel and moveable relative thereto, the first sleeve comprising a key carrier in which is located a plurality of keys biased radially outwards from the inner mandrel, each key having a second profile on an outer surface;

wherein the apparatus engages the inner sliding sleeve member via mating of the first and second profiles and a force on the upper end of the inner mandrel is transmitted to the inner sliding sleeve member; and the apparatus disengages from the inner sliding sleeve member by moving the upper facing lip over the plurality of keys to retract the keys to release the apparatus from the inner sliding sleeve member.

2. Apparatus according to claim 1 wherein the first sleeve includes at least one raised portion on an inner surface, the at least one raised portion providing an abutment surface to contact the second stop.

3. Apparatus according to claim 2 wherein there are a plurality of raised portions arranged equidistantly around a circumference of the inner surface of the first sleeve.

4. Apparatus according to claim 2 wherein the second stop does not extend entirely circumferentially around the inner mandrel so that, by radial alignment of the inner mandrel and the first sleeve, the abutment surface of the at least one raised portion is selectively: aligned to contact the second stop and thereby limit relative travel between the first sleeve and the inner mandrel; and misaligned, with the first sleeve bypassing the second stop to travel further relative to the inner mandrel.

5. Apparatus according to claim 4 wherein the inner mandrel includes at least one pocket arranged on an outer surface of the inner mandrel, a base of the at least one pocket being the second stop.

6. Apparatus according to claim 5 wherein the at least one pocket is dimensioned to accept the at least one raised portion.

7. Apparatus according to claim 6 wherein there are a plurality of pockets arranged equidistantly around a circumference of the outer surface of the inner mandrel.

8. Apparatus according to claim 7 wherein a slot is arranged between adjacent pockets so that when a raised portion is aligned with the slot, the first sleeve bypasses the second stop allowing the first sleeve to travel relatively further along the inner mandrel.

9. Apparatus according to claim 1 wherein the apparatus includes an indexing mechanism to provide radial alignment of the first sleeve and the inner mandrel, the indexing mechanism comprising: an upper orientation sleeve located around and attached to the inner mandrel, the upper orientation sleeve including a lower end with a first contour; a lower orientation sleeve, being the first sleeve, including an upper end with a second contour; the first and the second contours each comprising a longitudinal section and an angled section designed to mate when in contact, and wherein by picking up and shifting down of the work string rotational alignment of the inner mandrel and the first sleeve is controlled.

10. Apparatus according to claim 9 wherein the first contour is the first stop.

11. Apparatus according to claim 1 wherein the tool is a sub-surface safety valve and the inner sliding sleeve member is a flow tube of the sub-surface safety valve.

12. Apparatus according to claim 11 wherein the apparatus further comprises one or more jars to apply the force on the upper end of the inner mandrel.

13. A method of creating axial movement of an inner sliding sleeve member on a tool located in a well, the inner sliding sleeve member of the tool including a first profile on an inner surface, comprising the steps:

(a) running apparatus on a work string into the tool, the apparatus comprising:

an inner mandrel having a coupling at a first end to connect to the work string and an end cap with an upper facing lip at an opposing end, the inner mandrel including first and second spaced apart stops located there upon;

a first sleeve located around the inner mandrel and moveable relative thereto, the first sleeve comprising a key carrier in which is located a plurality of keys biased radially outwards from the inner mandrel, each key having a second profile on an outer surface;

(b) mating the first profile on the inner surface of the inner sliding sleeve member with the second profile of each key to engage the inner sliding sleeve member with the apparatus;

(c) applying a force on the upper end of the inner mandrel, the force being transmitted to and axially moving the inner sliding sleeve member; and (d) moving the upper facing lip over the plurality of keys to retract the keys and release the inner sliding sleeve member from the apparatus.

14. A method according to claim 13 wherein the method includes the step of operating the apparatus in a first configuration with the first sleeve abutting the first stop and the force is applied in a second direction to jar down on the inner mandrel and the inner sliding sleeve member.

15. A method according to claim 14 wherein the method includes operating the apparatus in a second configuration with the first sleeve abutting the second stop and the force is applied in a first direction to jar up on the inner mandrel and the inner sliding sleeve member.

16. A method according to claim 15 wherein the method includes operating the apparatus in a third configuration with the first sleeve bypassing the second stop and the apparatus is picked-up for the upper lip to slide over the keys and release the apparatus from the inner sliding sleeve member.

17. A method according to claim 13 wherein the method includes the further steps of locating the apparatus above the tool while remaining in a downhole environment; testing the inner sliding sleeve member from surface; and repeating steps (a) to (d).

18. A method according to claim 13 wherein the tool is a sub-surface safety valve, comprising a tubing retrievable flapper valve, and the inner sliding sleeve member is a flow tube of the sub-surface safety valve which is stuck in a closed position and the method includes the steps of: applying an opening pressure to a valve control line at surface; at step (c) jarring down multiple times while monitoring the control line pressure; looking for a pressure drop to indicate that the flow tube and piston are stroking down; and then releasing the apparatus as in step (d); functioning the valve by applying and bleeding off control line pressure; and measuring a volume of hydraulic fluid pumped into the valve to determine that it is fully opening and closing.

19. A method according to claim 13 wherein the tool is a sub-surface safety valve, comprising a tubing retrievable flapper valve, and the inner sliding sleeve member is a flow tube of the sub-surface safety valve which is stuck in an open position and the method includes the steps of: venting a valve control line to atmosphere; at step (c) jarring up multiple times while measuring the control line returns; matching a returned fluid volume with an expected returned fluid volume for the valve to indicate that the flow tube and hydraulic piston of the valve are stroking up; and then releasing the apparatus as in step (d); functioning the valve by applying and bleeding off control line pressure; and measuring a volume of hydraulic fluid pumped into the valve to determine that it is fully opening and closing.

20. A method according to claim 18 wherein the method includes the further steps of locking open the sub-surface safety valve for running and installing an insert valve, by: pressurizing tubing of the work string and recording the pumped volume to indicate when the pressure across the sub-surface safety valve is equalized and fluid is being pumped through the flapper valve; run in the apparatus and engage the first and second profiles; jar up strongly to shear release screws of the sub-surface safety valve; jar down strongly to push the flow tube through flapper and to lock the flow tube in open position; pump down the valve control line to verify that fluid is pumping into the tubing of the work string via a bore of the sub-surface safety valve; pick up to disengage the apparatus and pull out of hole.

* * * * *